US007950744B2

(12) United States Patent
Hallamek

(10) Patent No.: US 7,950,744 B2
(45) Date of Patent: May 31, 2011

(54) COLLAPSIBLE INTEGRAL FOOT REST

(76) Inventor: John A. Hallamek, Apache Junction, AZ (US)

( * ) Notice: Subject to any disclaimer, the term of this patent is extended or adjusted under 35 U.S.C. 154(b) by 140 days.

(21) Appl. No.: 12/383,255

(22) Filed: Mar. 20, 2009

(65) Prior Publication Data

US 2009/0256410 A1 Oct. 15, 2009

Related U.S. Application Data

(60) Provisional application No. 61/070,115, filed on Mar. 20, 2008.

(51) Int. Cl.
*A47C 20/00* (2006.01)

(52) U.S. Cl. ... 297/423.27; 297/45; 297/30; 297/423.25

(58) Field of Classification Search ..... 297/42–45, 297/30, 423.19–423.25, 423.4, 68, 83, 423.26–423.29; 108/118, 134; 5/115
See application file for complete search history.

(56) References Cited

U.S. PATENT DOCUMENTS

| | | | | |
|---|---|---|---|---|
| 2,604,146 | A * | 7/1952 | Martin | 297/423.22 |
| 3,484,132 | A * | 12/1969 | Biagi | 297/69 |
| 4,345,793 | A * | 8/1982 | Duda | 297/423.4 |
| 4,392,685 | A * | 7/1983 | Leonhart | 297/119 |
| 4,579,383 | A * | 4/1986 | Colby | 297/45 |
| 6,209,951 | B1 * | 4/2001 | Han | 297/45 |
| 6,231,119 | B1 * | 5/2001 | Zheng | 297/16.2 |
| 6,264,271 | B1 * | 7/2001 | Munn et al. | 297/45 |
| 6,364,410 | B1 * | 4/2002 | Tang | 297/16.2 |
| 6,402,230 | B1 * | 6/2002 | Tang | 297/16.2 |
| 6,629,722 | B1 * | 10/2003 | Tang | 297/45 |
| 6,634,609 | B2 * | 10/2003 | Zheng | 248/277.1 |
| 6,715,824 | B2 * | 4/2004 | Zheng | 297/16.2 |
| 6,776,433 | B2 * | 8/2004 | Harrison et al. | 280/647 |
| 6,817,671 | B1 * | 11/2004 | Zheng | 297/411.39 |
| 7,017,984 | B2 * | 3/2006 | Chen | 297/45 |
| 7,070,230 | B2 * | 7/2006 | Chen | 297/135 |
| 7,100,877 | B2 * | 9/2006 | Bourke et al. | 248/166 |
| 7,374,247 | B2 * | 5/2008 | Welsh et al. | 297/423.19 |
| 7,604,289 | B2 * | 10/2009 | Chen | 297/159.1 |
| 2004/0207237 | A1 * | 10/2004 | Chen | 297/45 |
| 2009/0140557 | A1 * | 6/2009 | Chen | 297/142 |

FOREIGN PATENT DOCUMENTS

EP 139306 A1 * 5/1985

* cited by examiner

*Primary Examiner* — Laurie K Cranmer
(74) *Attorney, Agent, or Firm* — Ober/Kaler; Royal W. Craig

(57) ABSTRACT

A collapsible footrest for universal use with similarly collapsible outdoor chairs comprising a fabric footrest panel supported vertically by a first pair of crossed support members and supported horizontally in relation to a chair by a second pair of crossed support members affixed to the chair at its base. The ends of the second crossed support members are joined by bi-directional couplings and hinged couplings that allow the footrest to fold into and collapse with the associated chair for storage while also limiting the motion of the footrest during use such that the foot rest panel is optimally positioned in an upright position to comfortably support a seated user's legs.

14 Claims, 7 Drawing Sheets

COLLAPSIBLE INTEGRAL FOOT REST

CROSS-REFERENCE TO RELATED APPLICATIONS

The present application derives priority from U.S. provisional application Ser. No. 61/070,115 filed Mar. 20, 2008.

BACKGROUND OF THE INVENTION

1. Field of the Invention

The present invention is generally directed to collapsible portable furniture and, more specifically, to a folding indoor/outdoor footrest accessory adapted to fold and collapse in multiple directions for universal use with folding indoor/outdoor chairs.

2. Description of the Background

The portability and ease of storage of folding outdoor furniture makes its use popular in a wide variety of applications such as beaches, parks, camping and all manner of family picnics or outings.

A variety of outdoor furniture pieces such as foldable tables, stools chairs and the like are available in a variety of designs. Folding chairs are known in the prior art that include a chair support assembly that folds in more than one direction resulting in a compact form that may be stored in an elongated bag. Such designs, often constructed of aluminum poles and canvas seating are lightweight yet sturdy and therefore suitable for use in a variety of settings and easy to transport. However, such chairs often have an upright back and inflexible design that prevents the user from fully relaxing while seated. Such designs similarly often lack a footrest on which the user can rest his or her feet while seated, further limiting the comfort of the user.

Chair owners desiring a footrest for use with their bi-direction collapsible chair must carry with them a separate foot stool or the like and setup such a foot stool separately. The need to carry a separate footrest diminishes the portability and convenience of the chair. Alternately, the collapsible chair owner may discard his chair altogether and seek out a lounge type chair with an integral footrest. Such lounges are significantly larger and less portable than conventional chairs such that the user again suffers from diminished convenience from his chair and is further faced with additional clutter for having multiple chairs for use in varying situations.

Additionally, where such collapsible lounge chairs of the prior art are equipped with a footrest they have generally employed a footrest design utilizing one or more rigid support members operatively tied to and supported by the main chair body itself via tension straps or cables. Such straps or cables interfere with the users ability to easily get into or out of the chair as they must be minded and stepped over each time to avoid tripping.

Thus there exists a need in the art for a footrest adapted to be added to most any collapsible chair on the market and capable of folding in at least two directions so as to be integrated into the design of such chairs. Such a foot rest should integrally fold away when not in use and be stored together with the chair within the original form factor of the chair while adding little or no weight. There exists a further need in the art for a footrest that does not impede the ease and ability of the user in getting into or out of the chair and does not create tripping hazards or dangerous situations. Such a footrest would enhance the functionality of the existing chairs, increasing the users comfort and convenience while also increasing the value such chairs and diminishing clutter.

The aforesaid and other advantages will become apparent to those skilled in he art as a more detailed description is set forth herein.

SUMMARY OF THE INVENTION

In accordance with an exemplary embodiment of the present invention, a collapsible footrest is provided comprising a canvas or polyester footrest panel supported vertically by a first pair of crossed support members and supported horizontally in relation to a chair by a second pair of crossed support members. The vertical and horizontal crossed support members are joined at their ends by a hinged coupling. The horizontal crossed support members are further joined to the chair by bi-directionally hinged couplings that are joined to the existing plastic foot pieces of the chair via an expandable post inserted into an existing hole on the foot piece and expanded to be secured by friction. The hinged and bidirectional couplings work in concert to allow the footrest device to fold into and collapse with the chair for storage and transport. The geometry of the vertical crossed support members and the design of the hinged coupling limit the rotation of the vertical crossed members during use such that the foot rest panel is optimally positioned in an upright position to comfortably support a seated user's legs.

The hinged coupling joining the ends of the horizontal and vertical support members is comprised of a yoke affixed to the horizontal member and into which the end of the vertical member is inserted and rotatably fixed by a pin. The rotational range of the vertical support members is limited such that they are maintained, when fully deployed, in a near vertical alignment in order to engage the seated user's feet. The canvas or polyester foot rest panel supported by the vertical support members is provided to support the feet and to limit the lateral motion of the vertical crossed members. The vertical support members are maintained in their upright position by their geometry and by the limited rotational range of the hinged coupling such that no supplementary support straps are required.

The bi-directional coupling is comprised of a yoke affixed to the foot piece of the chair and a spacer inserted into that yoke and rotatably fixed by a pin. The axis of rotation of the spacer pin is horizontally parallel to the plane of the front face if the chair. The horizontal crossed support member is rotatably affixed to the opposite end of the spacer by a pin whose axis of rotation is vertically parallel to the plane of the front face of the chair.

In another aspect of the present invention, in order to stow the footrest the vertical crossed supports and footrest panel may be rotated about the hinged coupling to lie flat against the horizontal crossed supports. Due to a bend in each vertical crossed support member the vertical crossed support members lie, when folded, in parallel plane to the horizontal crossed support members and are arranged to nest together. The nested crossed member supports may then by further rotated about the bi-directional support at the chair foot pieces so the crossed support members are aligned with the crossed support legs of the chair. The bidirectional couplings allow the footrest to be further collapsed laterally in cooperation with the main body of the chair and stored with the chair in its bag or the like.

The above and other objects, features and advantages of the present invention will become readily apparent from the following detailed description thereof which is to be read in connection with the accompanying drawings.

BRIEF DESCRIPTION OF THE DRAWINGS

Other objects, features, and advantages of the present invention will become more apparent from the following detailed description of the preferred embodiment and certain modifications thereof when taken together with the accompanying drawings in which.

DETAILED DESCRIPTION OF THE PREFERRED EMBODIMENTS

Figure 2:
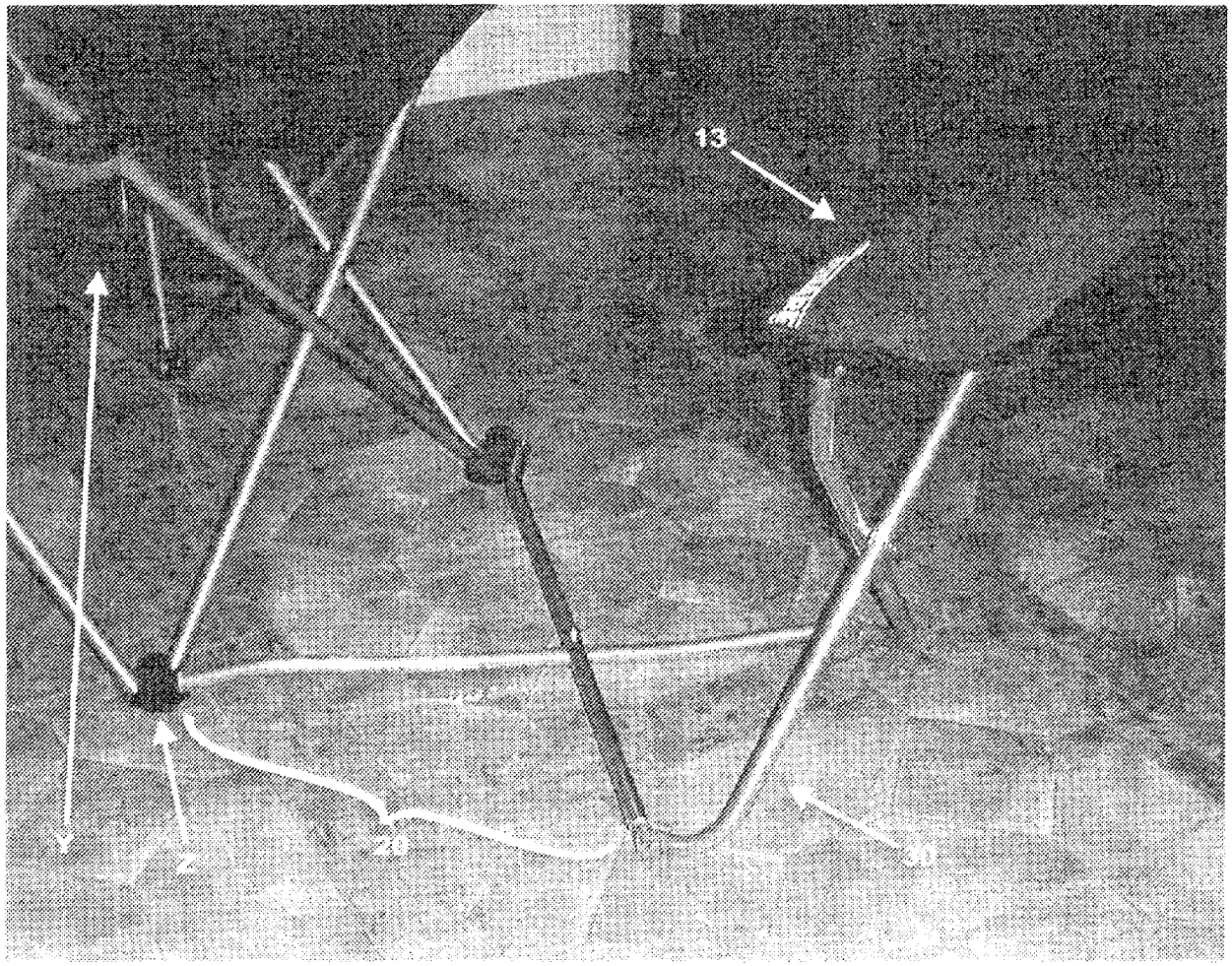
FIG. 2 is a perspective view of a preferred embodiment of the present invention in the deployed position.

Referring now to the figures, and in particular to FIG. 2, a perspective view is shown illustrating a collapsible portable footrest according to one embodiment of the present invention in cooperation with a folding chair. The folding chair (not claimed) includes a main body Y having, for example, four legs and seating surface and a back. The four legs are comprised, in this example, of a frame assembly which includes a plurality of interconnected X-members. Each of the X members includes a pair of bars or rods pivotally joined to one another and together cooperating to form a structure for supporting the fabric seat and back. The lower end of one bar or rod from each of two adjacent sides of the chair meets at the lower corner of the chair to form a leg, being affixed together there by a footpad Z for interface with the ground surface on which the chair is set. U.S. Pat. No. 5,984,406 issued to Howard Lee on Nov. 16, 1999 for a Folding Chair is but one example of the many collapsible chairs of this and similar designs. However, the chair main body Y may have any structure that is foldable and allows attachment of the footrest structure as described herein.

Figure 1:
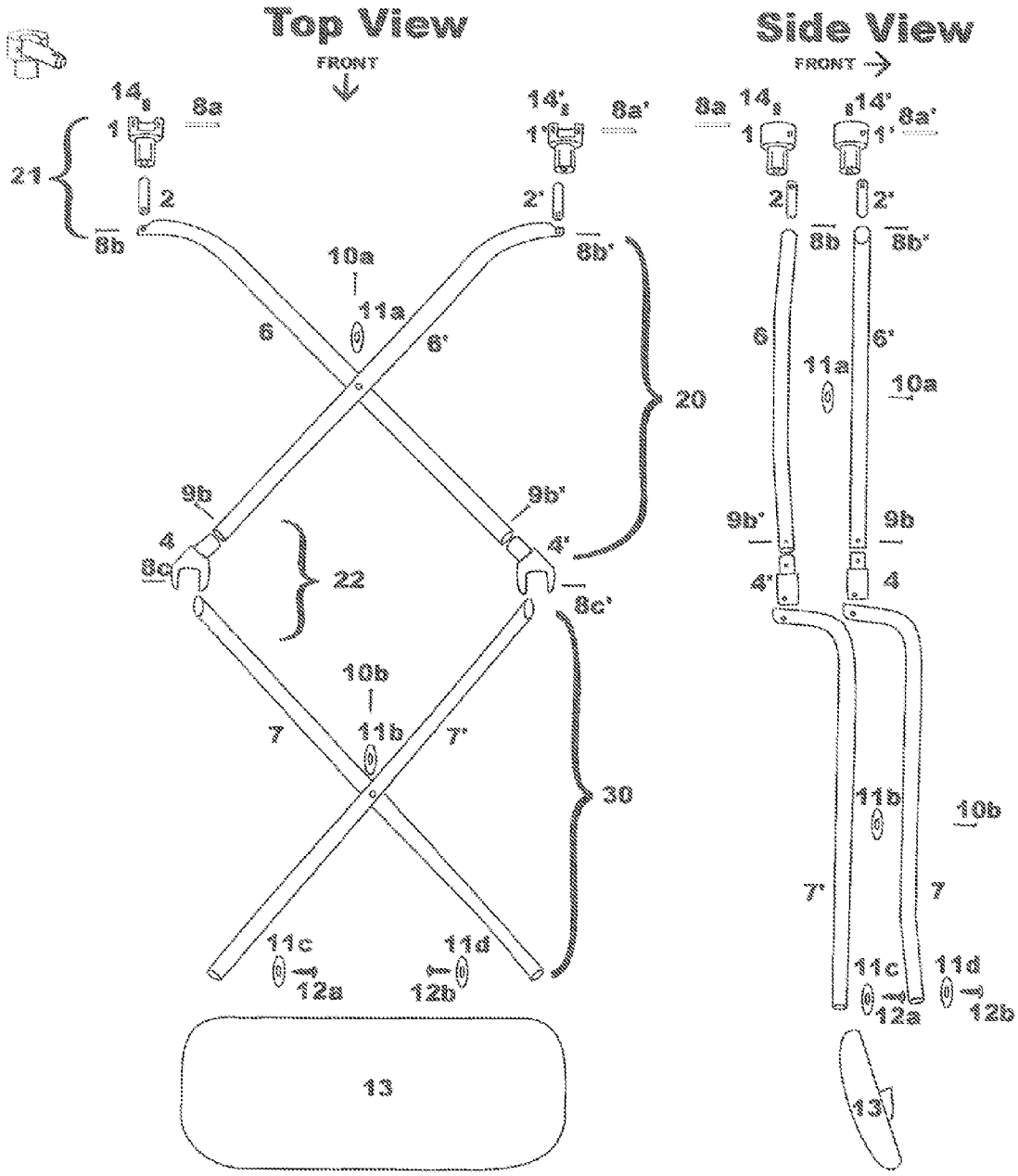
FIG. 1 is an exploded top and side view of one embodiment of the present invention.
Figure 3:
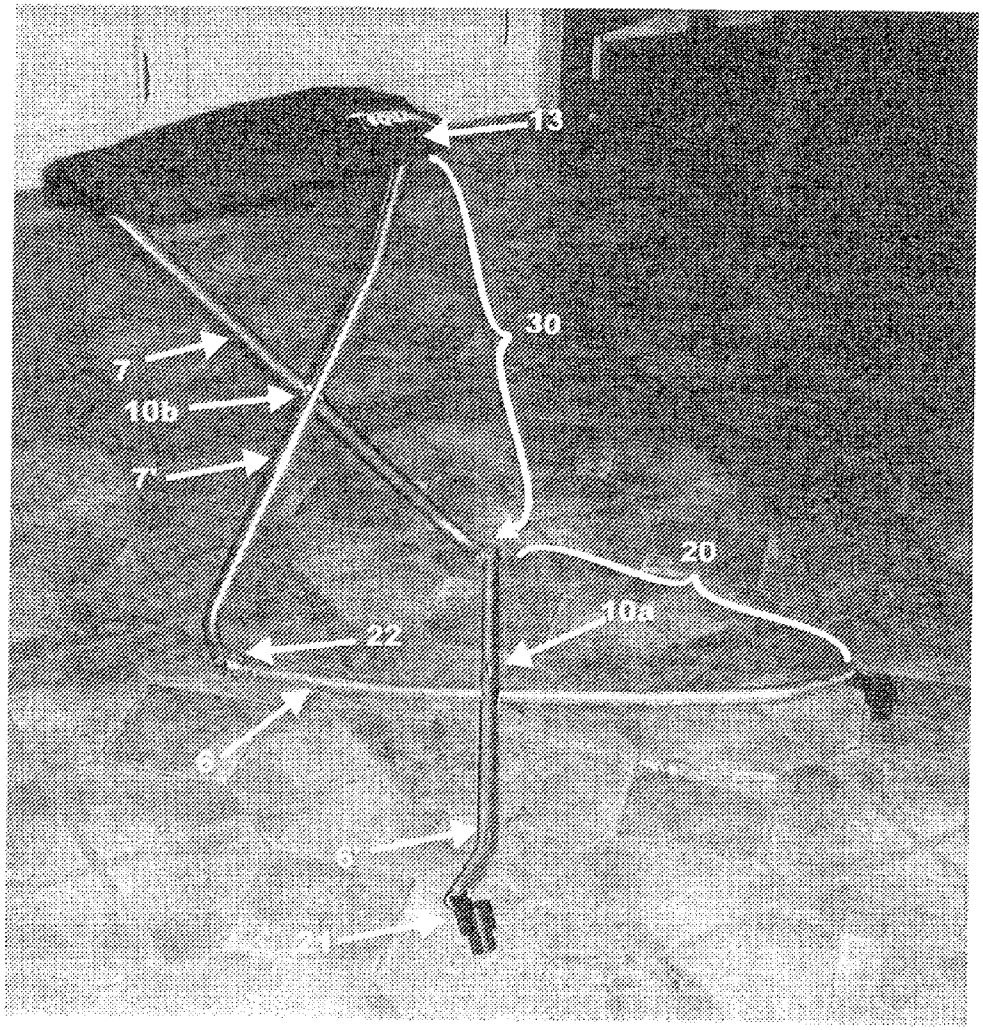
FIG. 3 is a perspective view of a preferred embodiment of the present invention in the deployed position dissociated from any chair.

Referring collectively to FIGS. 1, 2 and 3, the collapsible portable footrest according to the present invention includes a footrest panel 13 for providing a resting place for the feet of a user. The footrest panel is preferably made of flexible canvas, nylon or other flexible sheet material and may match the seat of the chair to which it is joined. One skilled in the art will recognize that footrest panel 13 may be made of any durable fabric material or, in some embodiments, rigid material such as wood or plastic. The footrest of the present invention includes means for operatively connecting the footrest panel to the folding chair as well as means for supporting the footrest panel in an elevated position relative to the ground on which the chair sits, and by extension, supporting the feet of a user in an elevated position as well.

The footrest panel 13 of the present invention is supported in an elevated position by vertical cross member support assembly 30 which includes first and second footrest support bars 7 and 7' which are pivotally connected to one another at a medial point by pin 10*b* or other similar conventional fastener. Each of footrest bars 7 and 7' has an upper end which is operatively connected to the footrest panel 13 and a lower end in communication with the ground surface on which the chair and footrest are set. The operative connection of the upper end of the footrest bars with the fabric of the footrest panel is preferably by screws 11*c*, 11*d* and/or fabric pockets such that pivoting of bar 7 and 7' about pin 10*b* is limited by fabric panel.

Footrest panel 13 as supported by cross member support assembly 30 is positioned and held in relative horizontal proximity to the main body Y of the folding chair by horizontal cross member support assembly 20. Horizontal support assembly 20 includes first and second footrest positioning bars 6 and 6' which are pivotally connected to one another at a medial point by pin 10*a* or other similar conventional fastener. Members 6 and 6' are preferably constructed of aluminum, steel or carbon fiber poles owing to their strength and weight characteristics although any similarly characterized material will be suitable. Each of positioning bars 6 and 6' has an inner end which is operatively connected to the foot piece of one of the front legs of the main body Y of the chair, and an outer end operatively connected to a lower end of vertical support bar 7 or 7'.

Figure 7:
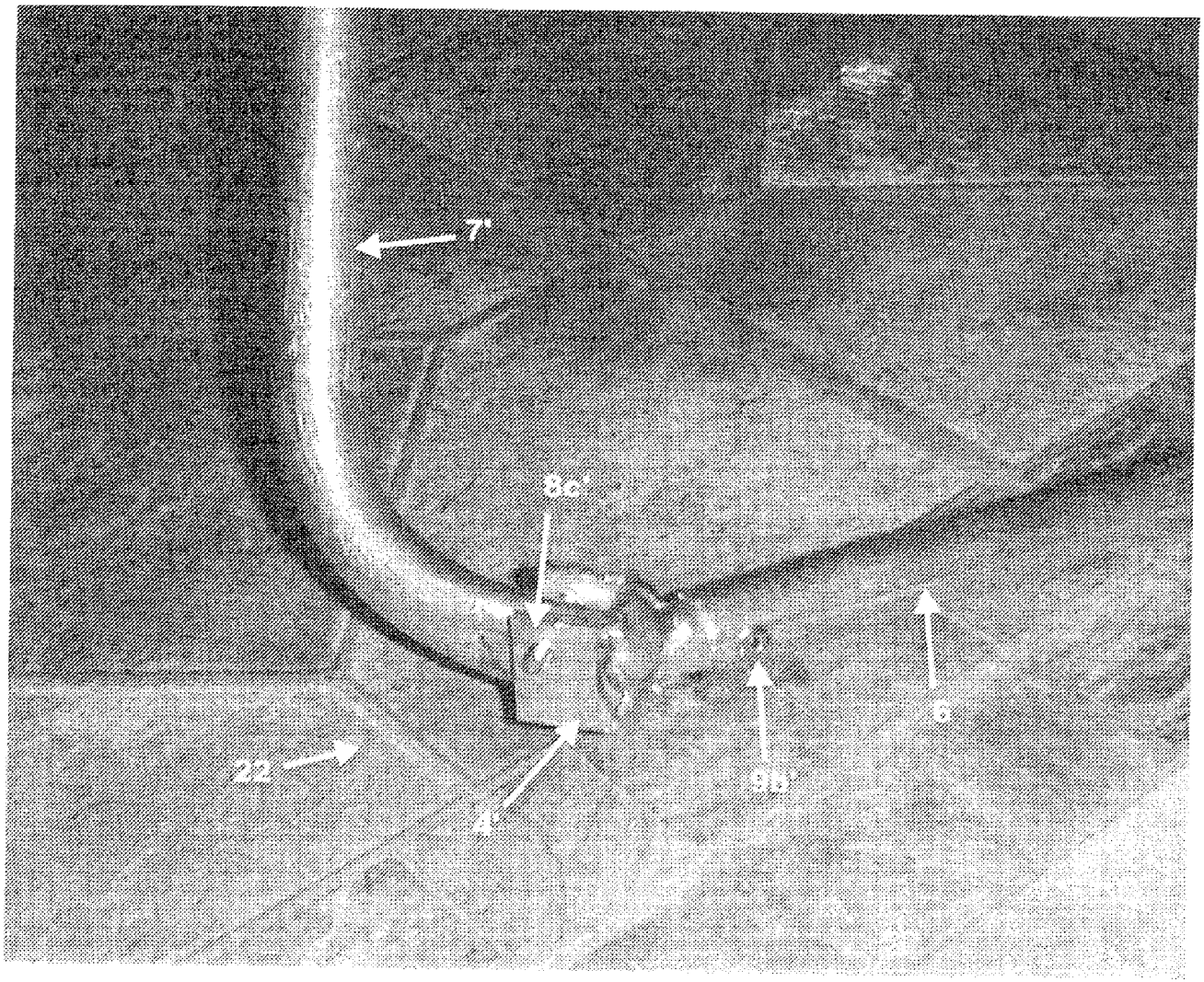
FIG. 7 is a detailed perspective view of the hinged coupling.

Referring now to FIGS. 1, 3, and 7, vertical support bars 7 and 7' are connected to horizontal support bars 6 and 6' by a joint 22 consisting of a hinged coupling. The yoke 4 and the vertical support members 7 and 7' are pivotally affixed by pin 8*c* whose axis of rotation in yoke 4, when deployed, is parallel to the front plane of the chair main body Y in order to allow the vertical crossed member support assembly 30 to rotate in toward the main body Y of the chair for storage. Vertical support members 7 and 7' are formed with an approximately 90 degree bend at the lower end before meeting the yoke 4. When deployed, the length of members 7 and 7' below the bend engages the ground surface limiting the travel of the vertical cross member support assembly about pin 8*c* and 8*c'* and maintaining it in a vertical or near vertical position to received the user's legs. The angle of the bend(s) in members 7 and 7' is depicted as 90 degrees although this angle may be varied in production to maximize the comfort of the user. The angle at which vertical cross member support assembly 30 is deployed may be further modified by limiting the rotational range of the assembly 30 about pin 8*c*, 8*c'* at the hinged coupling.

Figure 6:
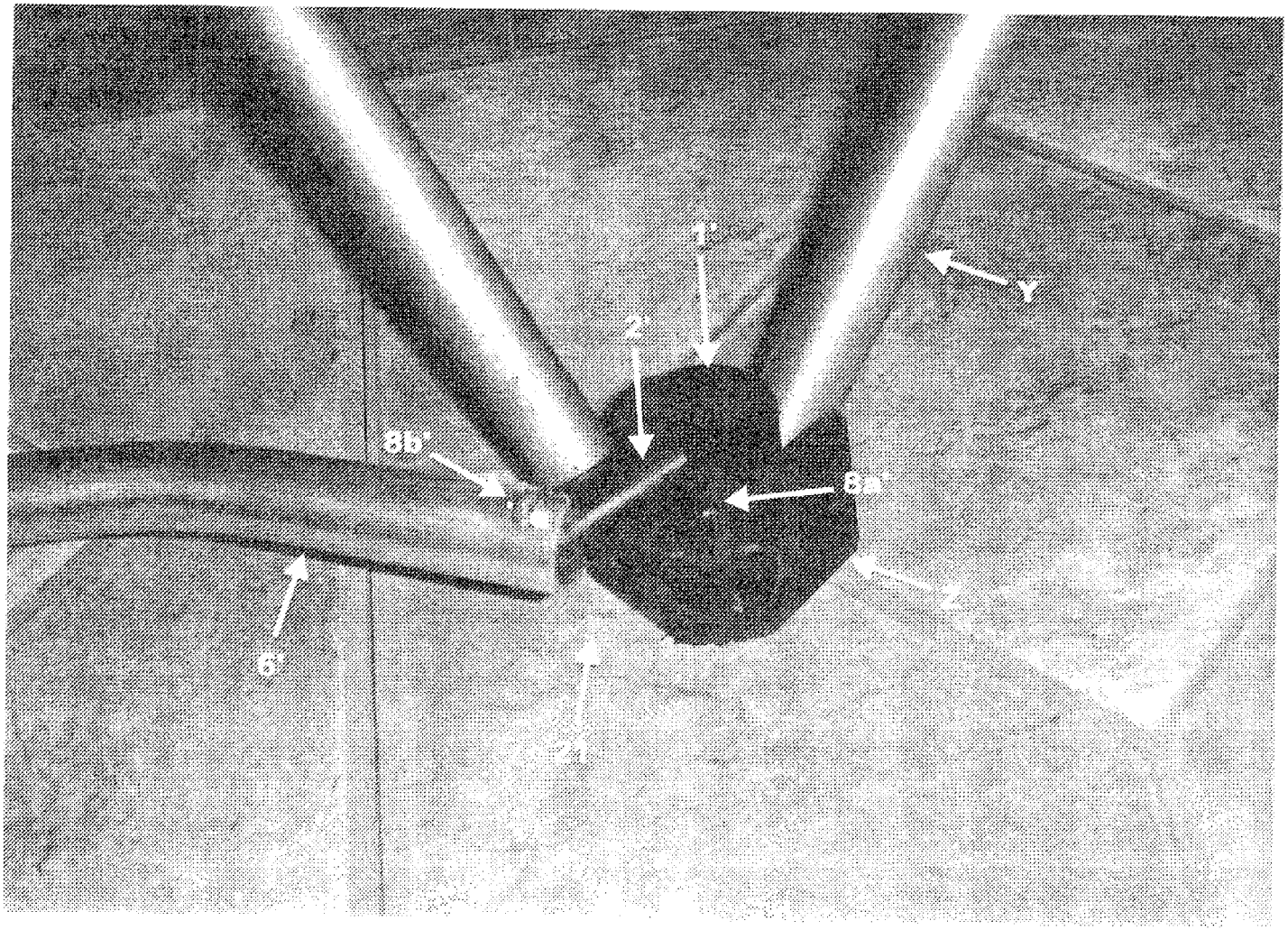
FIG. 6 is a detailed perspective view of the bi-directional coupling.

Referring now to FIG. 6, horizontal support bars 6 and 6' are connected to a front foot pieces Z of the main chair body by joint 21 in which the rotation of axis of the yoke 1 and 1' and the horizontal cross member 6 and 6' are perpendicular to one another and are offset laterally in one direction from one another by spacer 2. Yoke 1 and spacer 2 are pivotally affixed by pin 8*a* whose axis of rotation is horizontally parallel to the front plane of the chair main body Y in order to allow the horizontal crossed member support assembly 20 to rotate upward and inward toward the main body Y of the chair for storage. The horizontal cross members 6 and 6' are pivotally affixed to spacer 2 by pin 8*b* whose axis of rotation is vertically parallel to the front plane of the chair main body Y (when in the deployed position) such that the horizontal cross member support assembly 20 maintains the vertical assembly 30 in proper lateral relation to the chair main body. When stored, rotation of the horizontal cross members 6 and 6' around pin 8*b* permits the assembly 20 to be collapsed with the chair. Yoke 1 is affixed to a front foot piece of the chair main body Y by any conventional means. In the depicted embodiment a split post at the bottom of yoke 1 is inserted into hole commonly available in the foot piece of such chairs and secured by friction. A set screw in the top center of the yoke (not visible under spacer 2) may be turned clockwise applying force to and increasing the diameter of the post by spreading the split post sections of the yoke 1 inside the foot piece of the chair.

Figure 4:
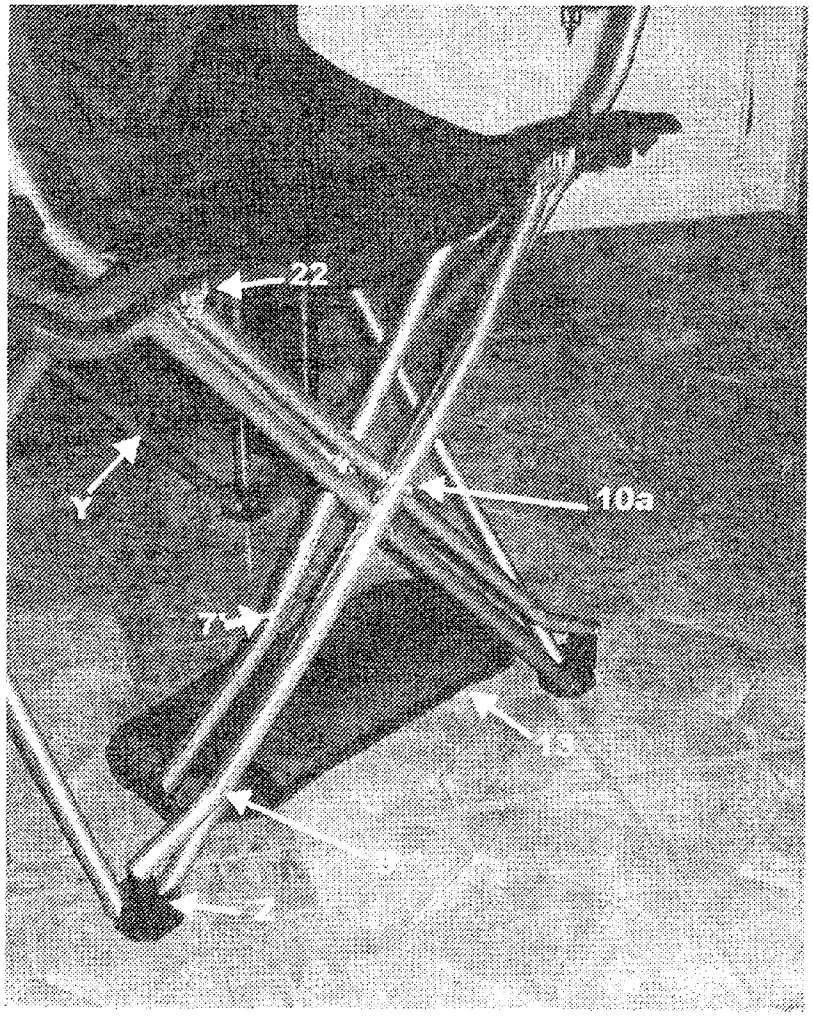
FIG. 4 is a perspective view of a preferred embodiment of the present invention in the stowed position.
Figure 5:
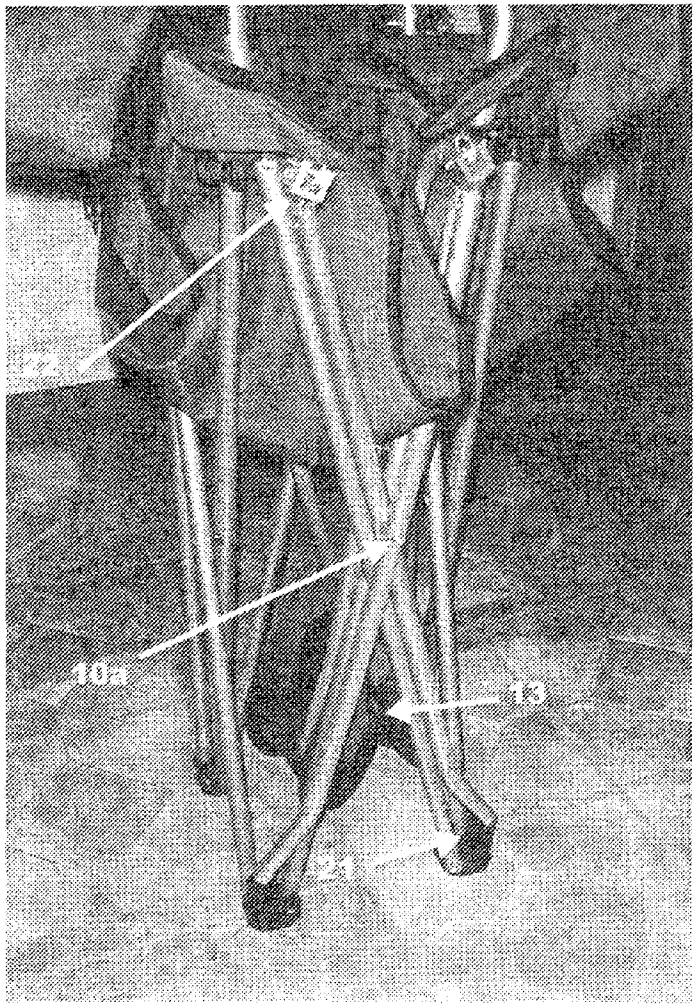
FIG. 5 is a perspective view of a preferred embodiment of the present invention in the stowed position further collapsed with the chair.

Referring now to FIG. 4, the chair is depicted in the stowed position in cooperation with the chair main body which remains in the deployed position. In FIG. 5, the chair main body has been further collapsed and it is seen that the footrest of the present invention is collapsed in accord with the chair main body for storage therewith. In operation, a footrest in the deployed position as depicted in FIG. 2 is collapsed into the stowed position of FIG. 4 by first lifting the footrest and rotating it about pins 8*a* and 8*a*' at the chair main body front foot pieces Z. As assembly 20 approaches a vertical position assembly 30 will enter the main body of the chair through the upper opening of the front cross members of the chair support structure under the seat of the chair. Once footrest panel 13 enters the main body of the chair it is rotated down about pins 8*c* and 8*c*' also into a vertical position, as seen in FIG. 4. In this position the crossed members of assemblies 20 and 30 are nested with the crossed members of the front of the chair main body with the chair main body crossed members between assembly 20 and assembly 30. This is made possible by spacer 2 and the bent vertical support tubing of joints 21 and 22 respectively that provide sufficient space for this nesting position with respect to the chair legs. A slight bend in the ends of members 6 and 6' may be provided to allow proper nesting of the members.

Further collapsing of the chair main body from the position depicted in FIG. 4 to the fully stowed position of FIG. 5 is made possible by the joints 21, 22. Specifically, rotation about pins 8*b*, 8*b*' and 8*c*, 8*c*' allows the footrest to collapse in concert with the chair. A stored chair and footrest may be operated into the deployed position by reversing this process.

Other variations are within the spirit of the present invention. Thus, while the invention is susceptible to various modifications and alternative constructions, a certain illustrated embodiment thereof is shown in the drawings and has been described in detail. It should be understood that there is no intention to limit the invention to the specific form or forms disclosed. Rather, variations to the preferred embodiments will become apparent to those skilled in the art upon reading the forgoing disclosure and it is the intention of the inventor to cover all such modifications and alternate constructions falling within the spirit and scope of the invention.

I claim:

1. A collapsible footrest for a folding chair having a seat and at least two legs extending downward from a front edge of said seat to a surface on which the chair rests, said footrest comprising:

a footrest panel;

a first pair of crossed support members pivotally engaged to one another at a mid point and each defining a proximal end affixed to said footrest panel and a distal end;

a second pair of crossed support members pivotally engaged to one another at a mid point and each defining a proximal end and a distal end, each of said distal ends of said second pair of support members pivotally engaged to a distal end of said first pair of support members by a hinged coupling allowing a limited range of relative pivotal movement about a single axis; and each of said proximal ends of said second pair of support members engaged to a leg of said chair by a bi-directional coupling allowing a limited range of relative pivotal movement about two axes;

whereby said footrest panel may be unfolded to a first upright position to comfortably support a seated user's legs, and folded to a second stowed position folded into and collapsed with the folding chair for storage.

2. The collapsible footrest of claim 1 wherein said distal end of each of said first pair of support members further comprises an approximately 90 degree bend and defines an integrally formed lower portion of each said support member below said bend.

3. The collapsible footrest of claim 2 wherein each hinged coupling further comprises a yoke engaged to a distal end of a support member of said second pair, and a pin retained in said yoke and inserted through a hole through said lower portion of a support member of said first pair, whereby said first pair of support members is permitted to rotate relative to said second pair of support members about an axis defined by said pin.

4. The collapsible footrest of claim 1 wherein each bidirectional coupling further comprises a yoke engaged to a leg of said chair, a first pin retained in said yoke and defining a first axis, a spacer, said first pin inserted through a hole formed in a first end of said spacer whereby said spacer is permitted to rotate about said first axis, a second pin retained in a proximal end of a support member of said second pair and defining a second axis perpendicular to said first axis, said second pin inserted through a hole formed in a second end of said spacer whereby said second pair of support members is permitted to rotate about said second axis.

5. The collapsible footrest of claim 1 wherein said support members are constructed of a material selected from the group consisting of aluminum, steel and fiber reinforced polymer.

6. The collapsible footrest of claim 1 wherein said footrest panel is constructed of a flexible fabric material.

7. The collapsible footrest of claim 6 wherein said footrest panel is constructed of a flexible fabric material selected from the group consisting of Nylon and canvas.

8. The collapsible footrest of claim 6 wherein said proximal ends of a said first pair of support members is engaged to said footrest panel in a fabric pocket formed in said footrest panel.

9. The collapsible footrest of claim 1 wherein said proximal ends of a said first pair of support members is engaged to said footrest panel by mechanical fastener.

10. A collapsible footrest for a folding chair having a seat and at least two legs extending downward from a front edge of said seat to a ground surface on which the chair rests, said footrest comprising:

a footrest panel;

a vertical support assembly engaged to and supporting said footrest panel, said vertical support assembly comprising a first support member having a first and a second end, said second end having an approximately 90 degree bend defining a distal portion below said bend orthogonal to a portion above said bend, a second support member having a first end and a second end, said second end having an approximately 90 degree bend defining a distal portion below said bend orthogonal to a portion above said bend, a midpoint of said second support member pivotally joined to a midpoint of said first support member, a horizontal support assembly engaged to said least two legs, said horizontal support assembly comprising a third support member having a first end pivotally to engaged one of said at least two legs and a second end, a fourth support member having a first end pivotally to engaged one of said at least two legs and a second end, a midpoint of said fourth support member pivotally joined to a midpoint of said third support member, each of said second ends of said support members of said vertical support assembly pivotally engaged by a hinged coupling to a second end of one of said support members of said horizontal support assembly whereby said footrest may be deployed in first position to support the legs of a user seated in said chair in which said horizontal support assembly is adjacent to said ground surface and said vertical support assembly is maintained in a vertical orientation by engagement of said distal portions with said ground surface, and folded to a second position for storage in which the footrest and chair may be collapsed together for storage.

11. The collapsible footrest of claim 10 wherein said a third support member and fourth support member are each affixed to a leg of said chair by a bi-directional coupling.

12. The collapsible footrest of claim 11 wherein said bi-directional couplings further comprises a yoke engaged to a leg of said chair, a first pin retained in said yoke and defining a first axis, a spacer, said first pin inserted through a hole formed in a first end of said spacer whereby said spacer is permitted to rotate about said first axis, a second pin retained in said first end of one of said support members of said horizontal support assembly and defining a second axis perpendicular to said first axis, said second pin inserted through a hole formed in a second end of said spacer.

13. The collapsible footrest of claim 10 wherein said hinged couplings further comprises a yoke engaged to a second end of a support member of said horizontal support assembly, and a pin retained in said yoke and inserted through a hole through said lower portion of a support member of said vertical support assembly, whereby said vertical support assembly is permitted to rotate relative to said horizontal support assembly about an axis defined by said pin.

14. A collapsible footrest for a folding chair having a seat and at least two legs extending downward from a front edge of said seat to a horizontal ground surface on which the chair rests and ending in a footpad having at least one hole vertically oriented there through, said footrest comprising:

a bidirectional coupling engaged to each said footpads, each comprising a yoke engaged to said vertical hole of said footpad a spacer pivotally retained in said yoke at a first end about a horizontal first axis and pivotally engaged to a horizontal support assembly at a second end about an second axis orthogonal to said first axis, a horizontal support assembly comprising a horizontal tubular support member engaged to each of said bi-directional couplings and pivotally engaged to one another at a midpoint, each tubular support member having a first end engaged to said bidirectional coupling and a second end engaged to a hinged coupling, and said hinged couplings further comprising a a yoke engaged to said second end of said support members and pivotally engaged to a vertical support assembly about a horizontal third axis, a vertical support assembly comprising a vertical tubular member pivotally engaged to each of said yokes and pivotally engaged to one another at a midpoint, each tubular support member having a first end engaged to said yoke, an approximately 90 degree bend proximal to said first end, and a second end, and a footrest panel engaged to said second end of each vertical tubular support member whereby said footrest may be deployed in first position to support the legs of a user seated in said chair in which said horizontal support assembly is adjacent to said ground surface and rotation of said vertical support assembly about said hinged coupling is limited by engagement of said 90 degree bend with said ground surface, and folded to a second position for storage in which the footrest and chair may be collapsed together for storage.

* * * * *